US005727426A

United States Patent [19]

Lykken et al.

[11] Patent Number: 5,727,426

[45] Date of Patent: Mar. 17, 1998

[54] MECHANISM FOR SELECTING LIMITS OF TRAVEL OF A LEVER

[75] Inventors: Thomas G. Lykken; William B. Rodriguez, both of Fargo, N. Dak.

[73] Assignee: Case Corporation, Racine, Wis.

[21] Appl. No.: 631,417

[22] Filed: Apr. 12, 1996

[51] Int. Cl.[6] ..... G05G 5/06

[52] U.S. Cl. ..... 74/526; 74/527; 74/532

[58] Field of Search ..... 74/526, 529, 532, 74/527; 172/9, 236, 303; 180/334, 335, 336

[56] References Cited

U.S. PATENT DOCUMENTS

| | | | |
|---|---|---|---|
| 3,301,086 | 1/1967 | Williams et al. | 74/475 |
| 3,942,390 | 3/1976 | Dunn | 74/529 |
| 3,972,249 | 8/1976 | Hansen | 74/526 |
| 4,091,877 | 5/1978 | Berg | 172/9 |
| 4,548,094 | 10/1985 | Huitema et al. | 74/526 |
| 4,641,545 | 2/1987 | Rabe | 74/476 |
| 5,062,316 | 11/1991 | Lykken et al. . | |
| 5,309,787 | 5/1994 | Soyka et al. | 74/527 |
| 5,445,046 | 8/1995 | Kataumi et al. | 74/527 |
| 5,458,021 | 10/1995 | Wichelt et al. | 74/536 |
| 5,499,553 | 3/1996 | Schott et al. | 74/526 |

*Primary Examiner*—Charles A. Marmor
*Assistant Examiner*—Mary Ann Battista
*Attorney, Agent, or Firm*—Jansson, Shupe, Bridge & Munger, Ltd.

[57] ABSTRACT

In the improvement, the slot portions are in a plate fixed with respect to the control lever. The mechanism includes an auxiliary lever and a selection device mounted for movement by the auxiliary lever for selecting a slot portion. The mechanism is used in an apparatus for manipulating plural valves. Such apparatus has two control assemblies, each having a valve control lever coupled to its respective plate, and two auxiliary levers. In a specific embodiment, each auxiliary lever is coupled to a selection bracket having parallel quadrant members with a selection device, e.g., a pin, mounted between the members. The pin is retained in registry with the selected one of the slot portions by a retention mechanism bearing against the selection bracket.

9 Claims, 6 Drawing Sheets

MECHANISM FOR SELECTING LIMITS OF TRAVEL OF A LEVER

FIELD OF THE INVENTION

The invention relates generally to machine elements and mechanisms and, more particularly, to control levers used to manipulate remotely-located hydraulic valves, for example.

BACKGROUND OF THE INVENTION

At least in mobile machinery, e.g., tractors, loaders and backhoes, the operator controls the machine using levers, pedals and the like which are mounted in the machine cab. Often, the machine is equipped with a hydraulic system for powering implements and each implement is controlled by one or more levers connected to respective hydraulic valves. And the range or limits of movement of such levers may differ from one another, depending upon the function being controlled by a particular lever.

The reason why the limits of lever movement may differ from lever to lever will be appreciated after considering the following. In an exemplary application involving a large agricultural tractor, a control lever and its associated hydraulic valve are used to raise and lower an implement (e.g., a tillage implement). For either direction of movement, the implement is "powered" in such direction by a hydraulic cylinder which forcefully urges the implement up or down.

But there are occasions in which the implement should be allowed to "float," i.e., to seek an elevation under force of gravity or under control of some sort of gauge device. The implement raise/lower hydraulic circuit is configured in such a way that on those occasions, the implement is permitted to move rather freely.

This is accomplished by moving the hydraulic valve to a float position beyond the range of positions used for powered raising and lowering. In the float position, the valve output ports (connected to the implement cylinder) are cross-connected to one another. In that way, the cylinder can move under the urging of the implement rather than vice versa.

And a control lever may be used for a purpose other than bi-directional implement raising, lowering and floating. For example, the machine may be equipped with a blower or fan powered for rotation (in only one direction, of course) by a hydraulic motor. Blowers (as well as certain other types of loads which may be imposed on the hydraulic motor) often have relatively-high inertia.

As a consequence, it is desirable to avoid attempting to abruptly stop the blower. Rather, the hydraulic valve is placed in a float position which permits such blower to coast to a stop. For unidirectionally-driven, high-inertia loads of the foregoing type, the hydraulic valve controlling the load should have very limited travel through only two positions, namely, "on" and "float." And irrespective of the throw range over which a control lever may be used, it is desirable to provide a way to secure such lever in a neutral or "lockout" position.

Examples of arrangements configured to limit lever throw are disclosed in U.S. Pat. Nos. 4,548,094 (Huitema et al.), U.S. Pat. No. 5,062,316 (Lykken et al.) and U.S. Pat. No. 5,458,021 (Wichelt et al.). The arrangements disclosed in the Huitema et al. and Wichelt et al. patents are closely similar and only the latter is discussed. The Wichelt et al. patent discloses a cylindrical guide member movable to any of four positions by rotating a thumb wheel. The guide member is retained in a selected position by a detent mechanism and is non-fixed, i.e., relatively movable with respect to a control lever with which it is associated.

In one position, the guide member locks the control lever in neutral while in two of the remaining three positions, the travel of such control lever is limited. In the fourth position, the lever is permitted to move over the full operating range of the hydraulic valve to which the lever is coupled. Rotational movement of the guide member is about an axis aligned with the linear path of movement of the control lever.

The apparatus of the Lykken et al. patent has a valve operating handle rigidly coupled to a plate having a notch, shoulder and control surface along the plate edge. A lever handle is used to manipulate the position of a pin to engage (or avoid engaging) the notch, shoulder or surface. After analyzing the specification of the Lykken et al. patent, it will be appreciated that differing ranges of lever throw may require replacing the profiled plate.

Apparatus like those of the Huitema et al. and Wichelt et al. patents require somewhat more space to install than some equipment designers are willing to allocate for the purpose. And such apparatus are somewhat less convenient to use than the invention.

OBJECTS OF THE INVENTION

It is an object of the invention to provide an improved mechanism for selecting a lever "throw" range.

Another object of the invention is to provide an improved mechanism overcoming some of the problems and shortcomings of the prior art.

Another object of the invention is to provide an improved mechanism which fits into an installation space smaller than that required by some prior art arrangements.

Yet another object of the invention is to provide an improved mechanism which is very easy to operate.

Another object of the invention is to provide an improved mechanism which may be ganged with others of its type. How these and other objects are accomplished will become apparent from the following descriptions and from the drawings.

SUMMARY OF THE INVENTION

In one of other possible applications, the invention permits the operator of a large agricultural tractor to select the range of "throw" of a lever used to control a hydraulic valve. The invention also permits such operator to place the lever in the "lockout" position where such lever is prevented from being moved.

An aspect of the invention involves a mechanism of the type having a plurality of slot portions for setting limits of movement of a control lever, e.g., a lever for controlling a hydraulic valve on a mobile machine. The magnitude and position of the lever "throw" range are dictated by that slot portion which is selected. In the improvement, the slot portions are arc-shaped and are in a flat plate fixed with respect to the control lever. Most preferably, the plate and lever are rigidly attached to one another.

The mechanism also includes an auxiliary lever used to select a particular slot portion in the plate. There is a selection device, e.g., a pin, mounted for movement by the auxiliary lever. The pin is thereby caused to come into registry with a particular slot portion and the magnitude and position of the throw range of the control lever is thereby selected.

The auxiliary lever is coupled to a plate-like quadrant member for moving such member. The selection device is mounted to the quadrant member and also moves when the auxiliary lever is moved.

In a more specific aspect of the invention, the control lever pivots with respect to a control axis, one of the slot portions defines an arc of a circle, the center of which is coincident with the control axis. In a highly preferred embodiment, there are at least first and second slot portions defining arcs of respective first and second circles. Such arcs are spaced from the control axis by differing distances. (In this specification, circles having arcs defined by slot portions are referred to as "slot-portion circles.")

The mechanism also has a retention apparatus for holding the selection device in registry with that slot portion which has been selected. There is also a spacer component that is fixed with respect to the plate coupled to the valve control lever. The retention apparatus includes a spring-biased member mounted in the spacer component and bearing against the plate. More specifically, the spring-biased member is a ball that engages any one 0f several detent apertures in the plate.

In another aspect of the invention, when the selection device (the exemplary pin noted above) is moved, it also defines an arc of a circle, referred to in this specification as a "selector-device circle." In a specific embodiment, an arc of a slot-portion circle and an arc of a selector-device circle intersect.

Mechanisms such as that described above are used in an apparatus for manipulating plural hydraulic valves. Such apparatus has at least first and second "ganged" control assemblies and perhaps several such assemblies. Each assembly comprises a valve control lever coupled to a slot portion plate of the type described above. Each assembly also has an auxiliary lever coupled to a quadrant member of the described type.

In the multi-assembly apparatus, the slot portion plates pivot about the control axis which is common to such plates. Similarly, the quadrant members pivot about a common auxiliary axis and the axes are generally parallel to one another.

The spacer component is interposed between the quadrant members of adjacent assemblies and has oppositely-directed first and second retention apparatus for retaining the first and second quadrant members at respective positions. Each retention apparatus operates independently of the other.

In an embodiment of the mechanism and associated apparatus, it is possible to use but a single quadrant member with each auxiliary lever. However, in the preferred embodiment, each auxiliary lever is coupled to a pair of coacting quadrant members, i.e., a pair of flat quadrant member plates rigidly joined together in spaced relationship to form a U-shaped selection bracket. The selection device, the exemplary pin, extends across the bracket between both quadrant members and the selection bracket is interposed between a pair of spacer components. Each spacer component includes a retention apparatus for retaining the selection bracket at a position. That is, each selection bracket has two retention apparatus acting upon it for position retention. Such cooperating retention apparatus act in opposite directions, one such retention apparatus being at each quadrant member forming the selection bracket.

In a specific application, the apparatus is used in a mobile machine such as an agricultural tractor. The plural valves are first and second hydraulic valves on the tractor and the plates of the first and second control assemblies are coupled to the first and second hydraulic valves, respectively. Assembly/valve coupling may be by a flexible remote-control cable, mechanical linkage or the like.

Further details of the invention are set forth in the following detailed description and in the drawings.

DETAILED DESCRIPTIONS OF PREFERRED EMBODIMENTS

Figure 1:
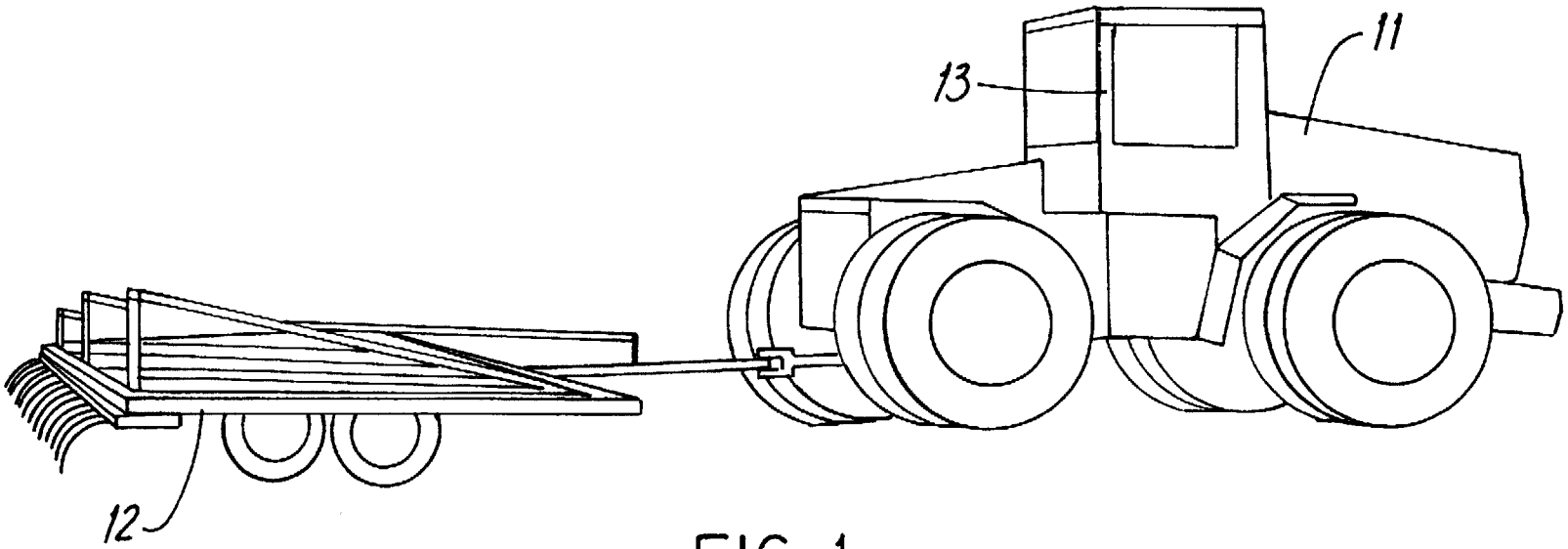
FIG. 1 PRIOR ART
FIG. 1 is a representative perspective view of an agricultural tractor and towed tillage machine, such exemplifying but one type of application on which the new mechanism may be used.
Figure 2:
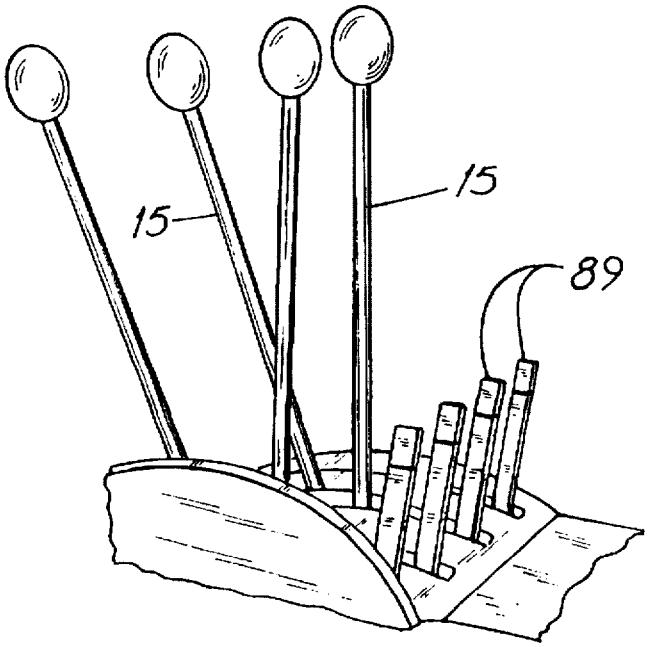
FIG. 2 is a perspective view of prior art control levers and auxiliary levers associated with the present invention and mounted in the cab of the tractor of FIG. 1.
Figure 3:
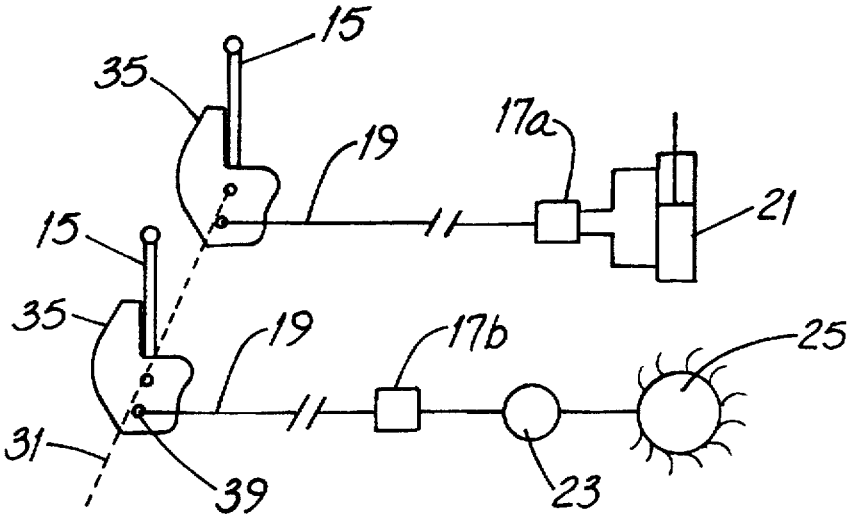
FIG. 3 PRIOR ART
FIG. 3 is a simplified diagram showing how control levers shown in FIG. 2 are used to control hydraulically-powered functions.

Before describing details of the new mechanism 10, it will be helpful to have an understanding of but one type of application on which such mechanism 10 may be used. Referring to FIGS. 1, 2 and 3, an exemplary mobile machine, an agricultural tractor 11 towing a tillage machine 12. Such tractor 11 has an operator's cab 13 equipped with several control levers 15 used to manipulate respective hydraulic valves 17*a*, 17*b* to which the levers 15 are connected. For purposes of explanation, FIG. 3 shows but two control levers 15 and two valves 17*a* and 17*b* connected by flexible remote-control cables 19. The hydraulic valves 17*a* and 17*b* are respectively connected to an implement-positioning cylinder 21 and to a rotary hydraulic motor 23 powering the implement, e.g., an exemplary cultivating tool 25.

Referring next to FIGS. 4, 5, 6 and 7 the mechanism 10 is supported by two rods 27 and 29 which are referred to as the control rod 27 and the auxiliary rod 29, respectively. Such rods 27, 29 are parallel to and spaced from one another and extend along a control axis 31 and an auxiliary axis 33, respectively. The rods 27, 29 support and permit pivoting movement of certain mechanism components described below.

The mechanism 10 includes a substantially flat plate 35 mounted on the control rod 27 for pivoting movement about the control axis 31. A control lever 15 is rigidly attached to the plate upper portion 37 and a flexible remote control cable 19 is attached at an eye 39 in the plate lower portion 41, forming a first class lever for cable movement.

Figure 7:
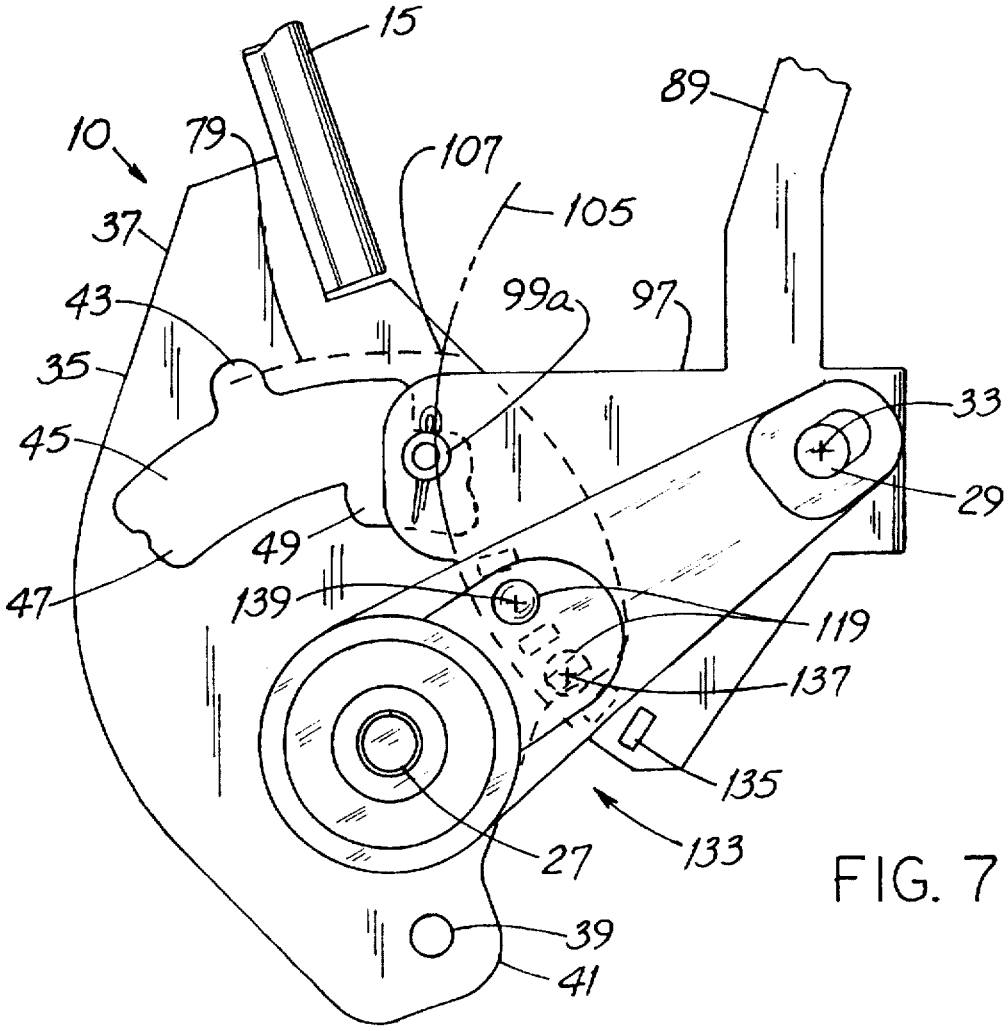
FIG. 7 is a side elevation view of the mechanism of FIG. 4 taken along the viewing axis VA7 thereof. Parts are broken away and surfaces of certain parts are shown in phantom, i.e., dashed outline.
Figure 8:
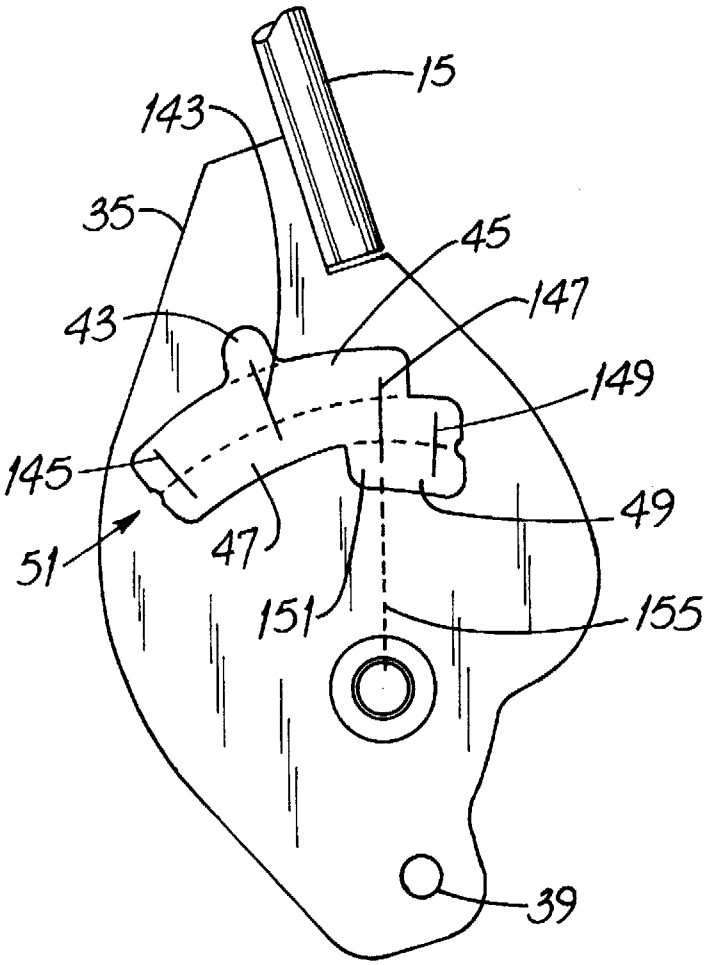

Referring particularly to FIGS. 7 and 8, the plate 35 has a plurality of arc-shaped slot portions formed therein, namely, portions 43, 45, 47 and 49. (In FIG. 8, such portions 43, 45, 47, 49 are delineated by dashed lines for ease of understanding.) In a specific embodiment, the portions 43, 45, 47, 49 are contiguous, extend through the plate 35 and formed an irregularly-shaped hole. As explained in more detail below, such portions 43, 45, 47, 49 are used for setting limits of movement of the lever 15 and the magnitude and position of the lever "throw" range are dictated by that slot portion 43, 45, 47 or 49 which is selected.

Figure 9:
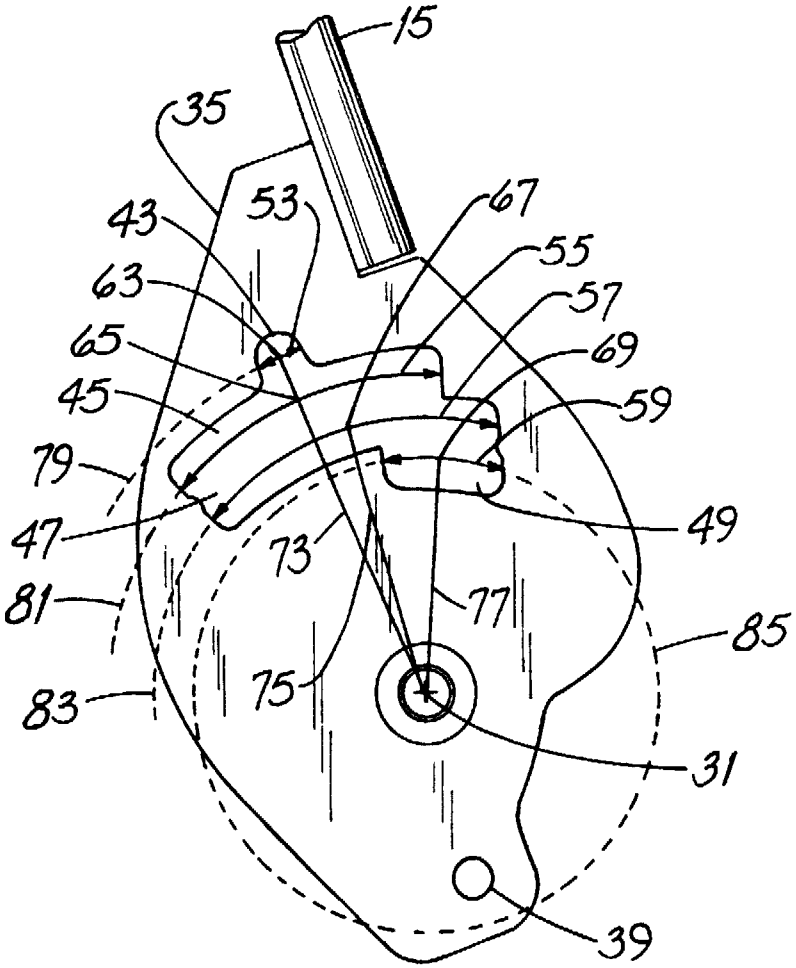
FIGS. 8 and 9 are side elevation views of the control plate component of the mechanism of FIGS. 4 and 7. Such views are taken along the viewing axis VA7. Parts are broken away.

Referring particularly to FIG. 9, several features of the plate 35 and its slot portions 43, 45, 47, 49 are apparent. One is that each portion 43, 45, 47, 49 has a different arc length as denoted by the differing lengths of the double-ended arrows 53, 55, 57, 59, respectively. Another is that the centers 63, 65 of the slot portions 43, 45 are coincident with the radius 73 and the centers 67, 69 of the slot portions 47, 49 are coincident with radii 75, 77, respectively. The radii 73, 75, 77 are of differing lengths and each slot portion 43, 45, 47, 49 is coincident with a separate arc (defined by the arrows 53, 55, 57, 59, respectively) that forms a portion of a separate circle 79, 81, 83, 85 each having a different diameter. For purposes of explanation, only the slot-portion circle 85 of which the arrow 59 forms a part is illustrated in its entirety and all slot-portion circles 79, 81, 83, 85 have their centers coincident with the control axis 31.

Referring now to FIGS. 2, 4, 5, 6, 7, 8 and 9, the mechanism 10 also includes an auxiliary lever 89 used to select a particular slot portion 43, 45, 47, 49 in the plate 35. Such lever 89 is coupled to or formed integrally with a pair of coacting quadrant members 91, 93. Such quadrant members 91, 93 are substantially flat and rigidly joined together in spaced relationship by a rib 95 to form a U-shaped selection bracket 97.

There is a selection device 99, e.g., a rigid pin **99*a*, mounted for movement by the auxiliary lever 89. The pin 99*a* extends through both quadrant members 91, 93 and is secured there by a cotter key 101. When the mechanism 10 is assembled, there is a quadrant member 91, 93 on either side of the plate 35 and the pin 99*a* extends through the hole 51**.

Referring particularly to FIGS. 7 and 9, the selection bracket 97 and the auxiliary lever 89 pivot with respect to the auxiliary axis 33. When the bracket 97 is pivoted, the pin **99*a* defines an arc 105 of a circle, referred to in this specification as a "selector-device circle." In a specific embodiment, an arc of a slot-portion circle 79 and an arc 105 of the selector-device circle intersect at the point 107. (From the foregoing, it is apparent that the arc 105 also intersects slot portion circles 81, 83, 85 at other points along the arc 105**.)

Considering FIGS. 7, 8 and 9, it is apparent that if the control lever 15 and plate 35 are moved to a position such that a particular slot portion, e.g., portion 47, is coincident with the arc 105, the auxiliary lever 89 may be moved so that the pin 99a is in registry with such slot portion 47. So long as the auxiliary lever 89 and the pin **99*a* are maintained in registry with such slot portion 47 (as by a retention mechanism described below), the magnitude of the control lever throw range is determined by the arc length (denoted by arrows 53, 55, 57 or 59) of the selected slot portion 43, 45, 47 or 49, respectively. And the position of such throw range is determined by, e.g., the location of the center 63, 65, 67 or 69 of such selected slot portion 43, 45, 47 or 49**, respectively.

Referring particularly to FIGS. 4, 5, 6, 7 and 10 the mechanism 10 also has a spacer component 109 mounted adjacent to the plate 35. Such component 109 has a pair of bushing ends 111, 113 through which the rods 27 and 29, respectively, extend. Between the ends 111, 113 is an arm 115 in which is mounted a member, e.g., a ball 119, biased outwardly by a spring 121. The arm 115, ball 119, plate 35 and detent apertures 135 in such plate 35 are cooperatively positioned so that the ball 119 bears against the plate 35 and engages any one of several detent apertures 135 in the plate 35.

Referring now to FIGS. 3, 4, 5, 7, 10 and 11, plural mechanisms 10 such as that described above are used in an apparatus 127 for manipulating plural hydraulic valves **17*a*, 17*b*. Such apparatus 127 has at least first and second control assemblies 129*a*, 129*b* which are "ganged." The apparatus 127 may have additional assemblies 129 (not shown). In the multi-assembly apparatus 127, the control axis 31 is common to the plates 35 and such plates 35, pivot about such axis 31. Similarly, the selection brackets 97 pivot about a common auxiliary axis 33**.

The spacer component 109 is interposed between the quadrant members 91, 93, respectively, of adjacent assemblies **129*a*, 129*b* and has oppositely-directed first and second retention apparatus 133 for retaining such quadrant members 91, 93 at respective positions. Each retention apparatus 133** operates independently of the other.

Figure 6:
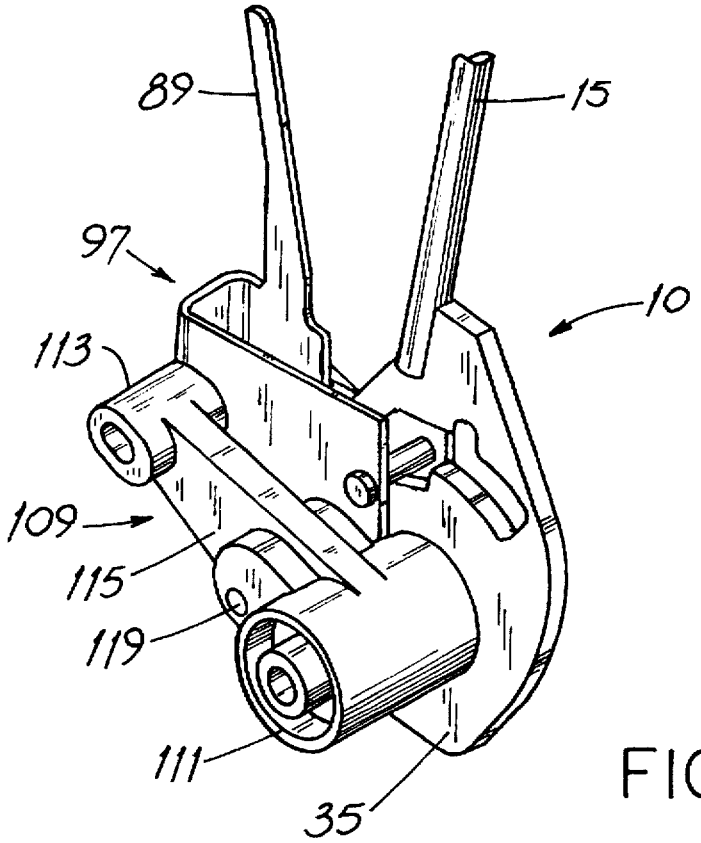
FIG. 6 is yet another perspective view of the mechanism of FIG. 4. Parts are broken away.
Figure 4:
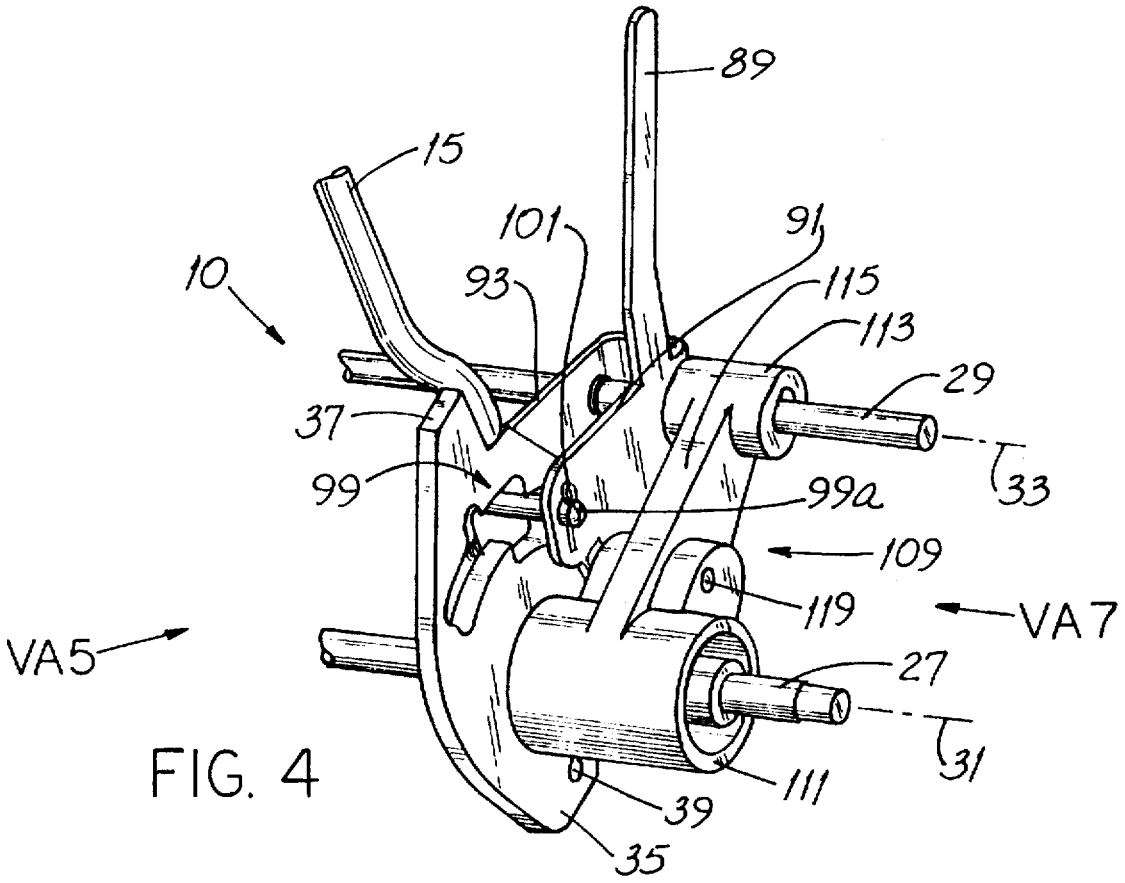
FIG. 4 is a perspective view of the new mechanism for selecting limits of travel of a control lever. Parts are broken away.
Figure 10:
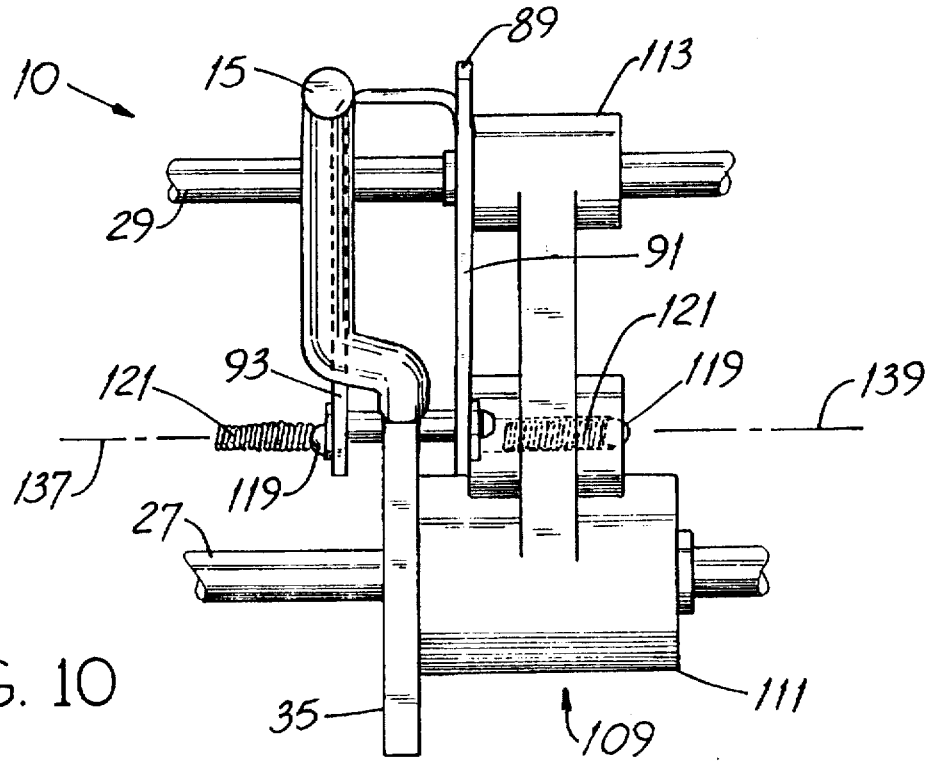
FIG. 10 is a top plan view of the mechanism of FIG. 4. Parts are broken away and surfaces of certain parts are shown in dashed outline.

Comparing FIGS. 4 and 6 and considering FIG. 10 in the preferred embodiment, the spring 121 and ball 119 of the one retention apparatus 133 are offset from the spring 121 and ball 119 of the other retention apparatus 133. (Note the relative positions of balls 119 in FIG. 7 and by comparing FIGS. 4 and 6.)

Considered another way, as shown in FIG. 10, the left-side spring 121 and ball 119 are coincident with an axis 137, the right-side spring 121 and ball 119 are coincident with an axis 139, and the axes 137, 139, are parallel and spaced apart as shown in FIG. 7.

Figure 11:
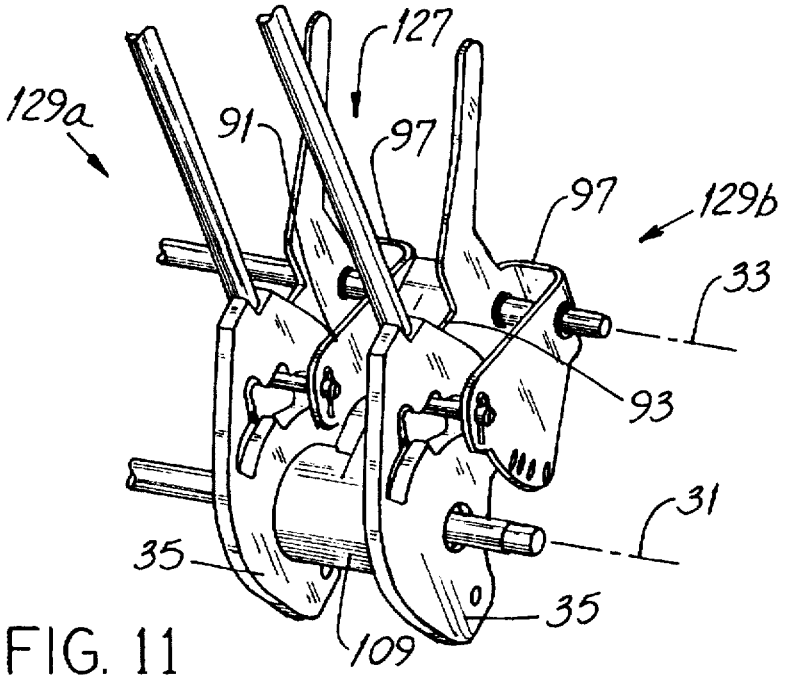
FIG. 11 is a perspective view of an apparatus for manipulating plural valves or the like. Such apparatus uses ganged control assemblies, each incorporating the new mechanism. Parts are broken away.
Figure 5:
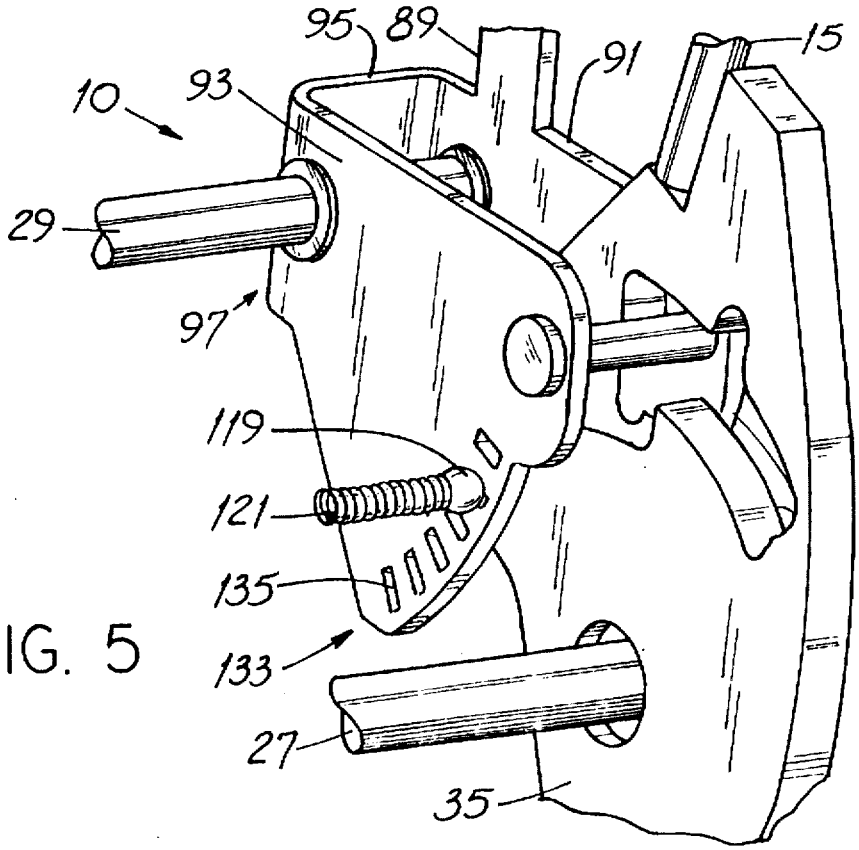
FIG. 5 is another perspective view of the mechanism of FIG. 4 taken generally along the viewing axis VA5 thereof. Parts are broken away.

In the apparatus 127 of FIG. 11, the spacer component 109 is interposed between a pair of selection brackets 97. From the foregoing and in the case of ganged assemblies **129*a*, 129*b* which use multiple spacer components 109, each selection bracket 97 has two retention mechanisms 133 acting upon it for position retention. In other words, a separate spring-biased ball 119 bears against each quadrant member 91, 93 forming the selection bracket 97**.

Considering the specific embodiment of FIGS. 4, 7 and 11, the ball 119 shown in FIG. 4 and in solid representation in FIG. 7 coacts with the upper four of the six detent apertures 125 formed in the quadrant member 93 of assembly **129*b*. The ball 119 on the other side of the spacer component 109 (that ball 119 in dashed outline in FIG. 7) coacts with the lower four of the six detent apertures 125 formed in the quadrant member 91 which is part of the adjacent assembly 129*a*. By providing six detent apertures 125 as shown, the person assembling the apparatus 127 need not be concerned with the orientation of the spacer component 109 on the rods 27, 29. And the thickness of such component 109 may be substantially reduced below that which would be required if both balls 119 and springs 121 mounted in a particular component 109** were coaxial.

Considering the FIGURES and particularly FIGS. 7 and 8, if the pin **99*a* is in the slot portion 43, the control lever 15** is locked out in the neutral position 143 and not available for use. If the pin 99*a* is in the slot portion 45, the lever 15 (and its associated valve 17) can be moved between the raise position 145, neutral position 143 and lower position 147. In this context, "raise position" and "lower position" denote positions to which the tool 25 is "powered" by a hydraulic cylinder 21 which forcefully urges the tool 25 up or down.

If the pin 99*a* is in the slot portion 47, the lever can be moved between the raise position 145, neutral position 143, lower position 147 and float position 149. With the lever 15 in the float position 149, the above-described tool 25 may seek an elevation under force of gravity or under control of a gauge device.

The slot portion 49 is used when the lever 15 is manipulated to control a unidirectional function such as driving the cultivating tool 25 mentioned above and shown in FIG. 3. The lever 15 can be moved between the driving or motoring position 151 and the float position 149.

For purposes of explaining how bi-directional and unidirectional functions are operated by a lever 15, the lowering position 147 and the driving/motoring position 151 are noted separately. Such positions 147, 151 are nominally coincident with the same radius 155. In FIG. 8, the positions 143, 145, 147, 149 and 151 are fixed in space and denote limits of travel of the lever 15 when the pin 99*a* is in a particular slot portion 43, 45, 47 or 49.

In this specification, a circle which includes an arc defined by a slot portion 43, 45, 47, 49 is referred to as "slot-portion circle" 79, 81, 83, 85, respectively. A circle which includes an arc 105 defined by the moving selection device 99, e.g., the exemplary pin 99*a* noted above, is referred to as a "selector-device circle." The term "quadrant member" 91, 93 is used to define a component of the mechanism 10 since, although having an angular span less than 90°, such member 91, 93 generally resembles a quadrant.

While the principles of the invention have been shown and described in connection with specific embodiments, it is to be understood clearly that such embodiments are by way of example and are not limiting. As but one example, a less preferred (but nevertheless operable) mechanism 10 may include but a single quadrant member 91 or 93 and a rigid pin 99*a* extending therefrom into the hole 51.

What is claimed is:

1. In a mechanism having a control lever and a plurality of slot portions for selecting limits of movement of the control lever, the improvement wherein:

the slot portions are in a plate fixed with respect to the control lever; and the mechanism includes an auxiliary lever and a selection bracket mounted for movement by the auxiliary lever for selecting one of the slot portions;

the selection bracket includes a spaced pair of members straddling the plate; and a selection device extends between the members.

2. The mechanism of claim 1 wherein:

the selection device extends through a hole in the plate.

3. The mechanism of claim 1 wherein:

the control lever pivots with respect to a control axis;

the slot portions include first and second slot portions defining arcs of respective first and second circles; and the arcs are spaced from the control axis by differing distances.

4. The mechanism of claim 1 including a retention apparatus for holding the selection device in registry with a selected one of the slot portions.

5. The mechanism of claim 4 including a spacer component mounted adjacent to the plate and wherein:

the auxiliary lever has a pivot axis;

the retention apparatus includes a spring-biased member mounted in the spacer component and bearing against the bracket at a location spaced from the pivot axis.

6. An apparatus coupled to plural valves, the apparatus including first and second control assemblies, each assembly comprising:

a valve control lever coupled to a plate having three arcuate slot portions therein;

an auxiliary lever coupled to a quadrant member having a selection device mounted thereon and moveable between each of the slot portions for selecting one of the slot portions;

and wherein:

each of the slot portions has an arc length different from the arc length of the other slot portions.

7. The apparatus of claim 6 including a spacer component interposed between the quadrant members and wherein:

the spacer component is stationary with respect to the levers; and the spacer component includes first and second retention apparatus for retaining the quadrant members at respective positions.

8. The apparatus of claim 6 wherein:

each control assembly includes two of said quadrant members;

each auxiliary lever is coupled to a respective pair of coacting ones of the quadrant members rigidly joined together to form a selection bracket;

the selection bracket is interposed between a pair of spacer components; and each spacer component includes a retention apparatus for retaining the selection bracket at a position.

9. The apparatus of claim 6 wherein:

two of the slot portions extend along respective arcs; and the arcs are spaced from a control axis by differing distances.

* * * * *